United States Patent [19]

Rorke

[11] Patent Number: 4,587,780

[45] Date of Patent: May 13, 1986

[54] SPIRAL STAIRCASE

[75] Inventor: Andrew J. Rorke, Revesby, Australia

[73] Assignee: Ebb Tide Pty., Ltd., Revesby, Australia

[21] Appl. No.: 555,452

[22] Filed: Nov. 28, 1983

[51] Int. Cl.[4] ..... E04F 11/00

[52] U.S. Cl. ..... 52/187; 52/182; 182/92

[58] Field of Search ..... 52/187, 182; 182/92; 248/222.1, 222.2, 224.4; 403/348, 349, 254

[56] References Cited

U.S. PATENT DOCUMENTS

| | | | |
|---|---|---|---|
| 116,441 | 6/1871 | Henley | 52/187 |
| 485,449 | 11/1892 | Borneman et al. | 52/187 |
| 614,177 | 11/1898 | McBride | 182/92 |
| 874,014 | 12/1907 | Kurtzon | 248/222.4 |
| 3,009,719 | 11/1961 | Otto et al. | 403/348 |
| 3,902,568 | 9/1975 | Erickson | 182/92 |

FOREIGN PATENT DOCUMENTS

| | | | |
|---|---|---|---|
| 53937 | 11/1937 | Denmark | 248/222.1 |
| 1056352 | 4/1959 | Fed. Rep. of Germany | 52/187 |
| 2758436 | 7/1979 | Fed. Rep. of Germany | 52/187 |
| 1271996 | 8/1961 | France | 52/187 |
| 212714 | 5/1967 | Sweden | 248/224.4 |
| 560305 | 3/1975 | Switzerland | 52/187 |

*Primary Examiner*—Carl D. Friedman
*Assistant Examiner*—Michael Safavi
*Attorney, Agent, or Firm*—David A. Jackson; Daniel H. Bobis

[57] ABSTRACT

A spiral staircase comprising a central hollow column of circular cross-sectional shape and a plurality of treads, said column having a plurality of apertures in its wall spaced spirally, each said tread having a curved locking plate at its inner end which lies contiguous with the outer face of the column and a locking pin projecting radially inwardly from the locking plate and extending through a respective aperture in the wall of the hollow column, each said locking pin having surfaces defining an upwardly extending slot which accommodates portion of the column wall, one of said slot surfaces bearing against the inner face of the column thereby inhibiting tilting of that tread.

3 Claims, 6 Drawing Figures

SPIRAL STAIRCASE

This invention relates to a spiral staircase wherein a plurality of treads are spaced spirally and radiate outwardly from a central column.

Spiral staircases are of course well known and the most commonly used spiral staircase has a central column, a plurality of treads each terminating at its inner end in a ring, and a plurality of spacer rings.

With the use of such existing kit-type spiral staircases there are a number of difficulties, and these include the tendency for the stair to move in a rotational direction if a lateral force is applied thereto, or alternatively the need to have on-site welding, relatively high cost because of the use of stair rings and spacer rings, difficulty in achieving the same rise for all treads, and the need to have more than one man to install.

The main object of this invention is to reduce the abovementioned problems, and at the same time reduce the number of parts required, and in this invention a spiral staircase comprises a central hollow column of circular cross-sectional shape and a plurality of treads, said column having a plurality of apertures in its wall spaced spirally, each said tread having a curved locking plate at its inner end which lies contiguous with the outer face of the column and a locking pin projecting radially inwardly from the locking plate and extending through a respective aperture in the wall of the hollow column, each said locking pin having surfaces defining an upwardly extending slot which accommodates portion of the column wall, one of said slot surfaces bearing against the inner face of the column thereby inhibiting tilting of that tread.

Figure 1:
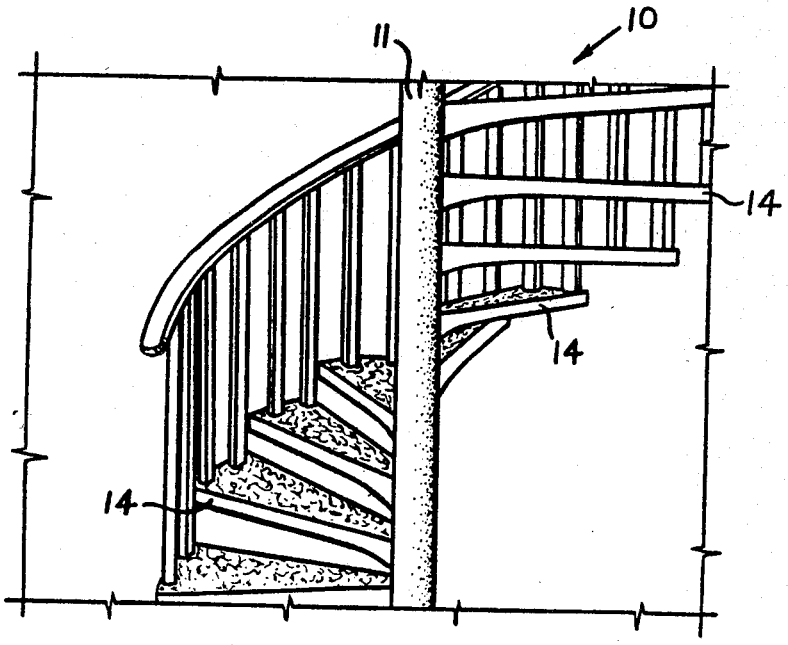
Figure 2:
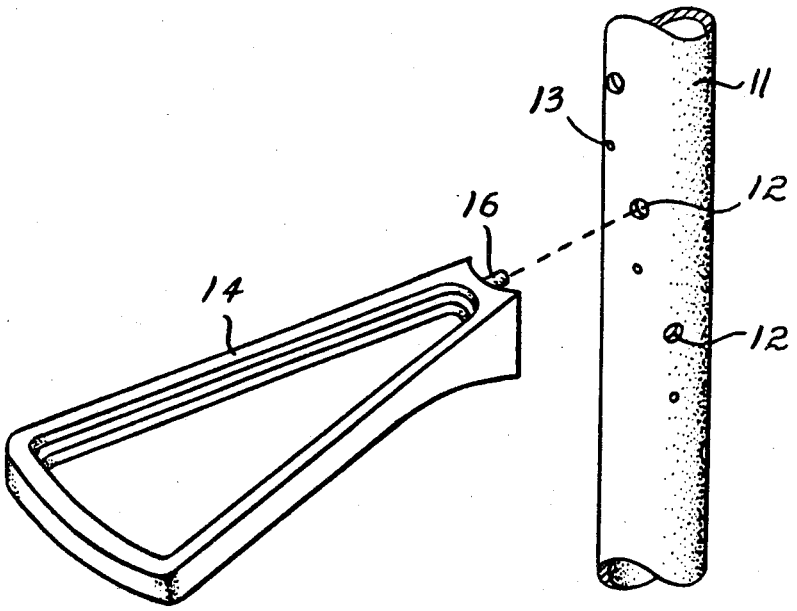
Figure 3:
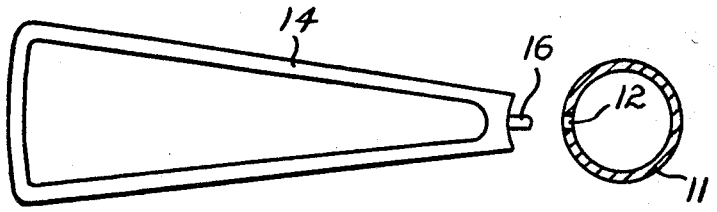
Figure 4:
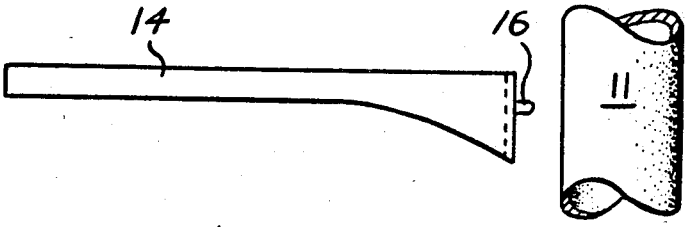
Figure 5:
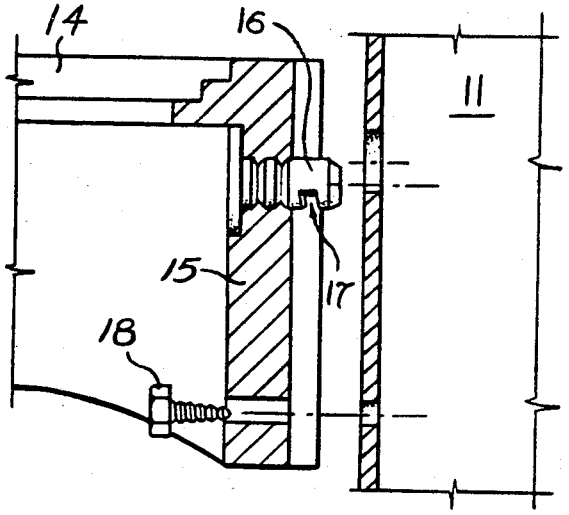
Figure 6:
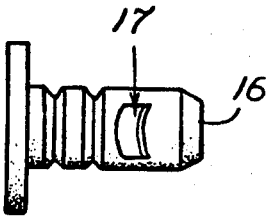

An embodiment of the invention is described hereunder in some detail with reference to, and is illustrated in, the accompanying drawings, in which FIG. 1 is a fragmentary perspective view of a staircase, FIG. 2 is a fragmentary "exploded" view of a column and tread, FIG. 3 is a plan view of same, FIG. 4 is an elevation of same, FIG. 5 is an enlarged fragmentary elevational section of same, and FIG. 6 is an underside view of the locking pin.

In this embodiment a spiral staircase 10 is provided with a vertical column 11, and a first group of apertures 12, and a second group of apertures 13, are drilled into the wall of the column, each group being arranged spirally up the column.

Each tread 14 has a curved locking plate 15 at its inner end which is arranged to lie contiguous with the outer face of the column for portion only of the column's circumference, and the locking plate 15 has extending from it a locking pin 16, the locking pin having a slot 17 in its undersurface, the slot shape being part circular in plan and in end elevation, the surfaces which define the slot having curvatures corresponding to the curvatures of the complementary surfaces which they engage when the pin is inserted in an aperture 12 in the column. The slot 17 is rearwardly of the locking plate so that the rear wall of the slot lies contiguous with the inner face of the column if the locking pin is fed into a hole and the tread is lowered. The side walls of the slot slope as shown in FIG. 5, so that lowering of the stair clamps the locking plate 15 against the outer face of column 11. This provides the main resistance to prevent displacement of the tread in a downward or outward direction. The tread 14 is further secured to the column by means of a self-tapping locking bolt 18 which extends through the locking plate 15 and threadably engages the wall of the column 11.

A consideration of the above embodiment will indicate that the invention is extremely simple. By utilising simple jig means, the apertures can be accurately located up the column following the spiral path, and can be quickly and easily drilled by a single operator. This facilitates even distribution of the risers over the entire height of the staircase. Because of the strength of the locking pin, downward deflection of the stair tread is firmly resisted, and because of the use of the locking bolt, lateral deflection is also substantially avoided. Since no use is made of rings, the cost is relatively low, and the installation is simple and inexpensive. The absence of locking rings also improves the aesthetics of a staircase constructed in accordance with this invention.

I claim:

1. A spiral staircase comprising:

a central hollow column of a circular cross-sectional shape, said column having a wall, an outer face, an inner face and a plurality of apertures in the wall spaced spirally thereabout, and a plurality of treads, each said tread having an inner end with a curved locking plate thereat which lies contiguous with the outer face of the column and a locking pin projecting radially inwardly from the locking plate and extending through a respective aperture in the wall of the hollow column, each said locking pin having surfaces defining an upwardly extending slot which accommodates a portion of the column wall, said slot surfaces being curved both in plan and in end elevation and having curvatures which conform with the curvatures of the complementary faces of the column which they engage when the locking pin is inserted into a respective aperture in the column, one of said slot surfaces bearing against the inner face of the column thereby inhibiting tilting of that tread.

2. A spiral staircase according to claim 1 further comprising a threaded fastener further securing the locking plate to the column.

3. A spiral staircase according to claim 1 wherein the opposite surfaces of the slot slope upwardly towards the locking plate.

* * * * *